US006753307B1

(12) United States Patent
Panandiker et al.

(10) Patent No.: US 6,753,307 B1
(45) Date of Patent: Jun. 22, 2004

(54) LAUNDRY DETERGENT COMPOSITIONS WITH A CATIONICALLY CHARGED DYE MAINTENANCE POLYMER

(75) Inventors: Rajan Keshav Panandiker, West Chester, OH (US); Sherri Lynn Randall, Hamilton, OH (US); Janet Sue Littig, Fairfield, OH (US); Eugene Paul Gosselink, Cincinnati, OH (US); David William Bjorkquist, Wyoming, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/806,881

(22) PCT Filed: Oct. 13, 1999

(86) PCT No.: PCT/US99/22935

§ 371 (c)(1),
(2), (4) Date: Jul. 11, 2001

(87) PCT Pub. No.: WO00/22077

PCT Pub. Date: Apr. 20, 2000

Related U.S. Application Data

(60) Provisional application No. 60/148,053, filed on Aug. 10, 1999, provisional application No. 60/126,074, filed on Mar. 25, 1999, and provisional application No. 60/103,978, filed on Oct. 13, 1998.

(51) Int. Cl.[7] ..... C11D 3/37
(52) U.S. Cl. ..... 510/475
(58) Field of Search ..... 510/475, 516

(56) References Cited

U.S. PATENT DOCUMENTS 4,371,517 A * 2/1983 Vanlerberghe et al. ..... 424/70
4,418,011 A 11/1983 Bauman et al.
5,789,373 A 8/1998 Baker et al.
6,025,322 A * 2/2000 Boeckh et al. ..... 510/516
6,214,786 B1 4/2001 Randall et al.
6,228,828 B1 5/2001 Panandiker et al.
6,251,846 B1 6/2001 Panandiker et al.
6,287,585 B1 * 9/2001 Johansen ..... 424/405
6,407,053 B1 6/2002 Randall et al.
6,482,787 B1 11/2002 Panandiker et al.

FOREIGN PATENT DOCUMENTS

| | | |
|---|---|---|
| DE | 196 43 281 A1 | 4/1998 |
| EP | 0 864 642 A1 | 9/1998 |
| FR | 2 436 213 | 4/1980 |

OTHER PUBLICATIONS

Panadiker et al., Laundry Detergent Compositions with A Combination Of Cyclic Amine Based Polymers And Hydrophobically Modified Carboxy Methyl Cellulose, Allowed Claims May 21, 2003, Ser. No. 09/806,882.

* cited by examiner

*Primary Examiner*—John Hardee
(74) *Attorney, Agent, or Firm*—S. Robert Chuey; Julia A. Glazer; Brahm J. Corstanje

(57) ABSTRACT

A detergent composition comprising from about 4% to about 70% of a surfactant, and from about 0.05% to about 10% of a dye maintenance polymer or oligomer having at least three net positive chages per molecule. The dye maintenance polymer should have a Dye Maintenance Parameter, as determined by the Dye Maintenance Parameter Test defined herein, of greater than about 0.23. Further, the dye maintenance polymer is not a polyethyleneimine or alkoxylated derivative thereof.

10 Claims, No Drawings

LAUNDRY DETERGENT COMPOSITIONS WITH A CATIONICALLY CHARGED DYE MAINTENANCE POLYMER

This application claims priority from U.S. Provisional Applications 60/126,074, filed Mar. 25, 1999; 60/148,053, filed Aug. 10, 1999; and 60/103,978, filed Oct. 13, 1998.

TECHNICAL FIELD

The present invention relates to compositions, in either liquid or granular form, for use in laundry applications, wherein the compositions comprise certain dye maintenance polymers that have a net positive charge. A standardized test is provided that determines the dye maintenance parameter for any given polymer. Compositions comprising the dye maintenance polymers of this invention impart appearance and integrity benefits to fabrics and textiles laundered in washing solutions formed from such compositions.

BACKGROUND OF THE INVENTION

It is, of course, well known that alternating cycles of using and laundering fabrics and textiles, such as articles of worn clothing and apparel, will inevitably adversely affect the appearance and integrity of the fabric and textile items so used and laundered. Fabrics and textiles simply wear out over time and with use. Laundering of fabrics and textiles is necessary to remove soils and stains which accumulate therein and thereon during ordinary use. However, the laundering operation itself, over many cycles, can accentuate and contribute to the deterioration of the integrity and the appearance of such fabrics and textiles.

Deterioration of fabric integrity and appearance can manifest itself in several ways. Short fibers are dislodged from woven and knit fabric/textile structures by the mechanical action of laundering. These dislodged fibers may form lint, fuzz or "pills" which are visible on the surface of fabrics and diminish the appearance of newness of the fabric. Further, repeated laundering of fabrics and textiles, especially with bleach-containing laundry products, can remove dye from fabrics and textiles and impart a faded, worn out appearance as a result of diminished color intensity, and in many eases, as a result of changes in hues or shades of color.

Given the foregoing, there is clearly an ongoing need to identify materials which could be added to laundry products that would associate themselves with the fibers of the fabrics and textiles laundered using such products and thereby reduce or minimize the tendency of the laundered fabric/textiles to deteriorate in appearance. Any such detergent product additive material should, of course, be able to benefit fabric appearance and integrity without unduly interfering with the ability of the laundry product to perform its intended function. The present invention is directed to the use of dye maintenance polymers in laundry applications that perform in this desired manner, and a test for determining the Dye Maintenance Parameter for any given polymer.

SUMMARY OF THE INVENTION

The present invention is directed to a detergent composition comprising:

a) from about 4% to about 70% of a surfactant that is preferably selected from the group consisting of nonionic, anionic, cationic, amphoteric, zwitterionic surfactants and mixtures thereof, and is even more preferably an anionic surfactant;

b) from about 0.01% to about 10%, preferably from about 0. 1% to about 8%, more preferably from about 0.5% to about 6%, and most preferably from about 0.8% to about 5% of a dye maintenance polymer or oligomer having at least three net positive charges per molecule and having a Dye Maintenance Parameter, as determined by the Dye Maintenance Parameter Test, of greater than about 0.23, preferably greater than about 0.6 more preferably greater than about 0.8 and most preferably greater than about 0.9.

The dye maintenance polymer is not a polyethyleneimine or alkoxylated derivative thereof.

In another aspect of this invention there is provided a fabric conditioning composition comprising:

a) from about 1% to about 80% of a fabric softening active; and b) from about 0.01% to about 50%, preferably from about 0.1% to about 40%, more preferably from about 0.5% to about 30%, and most preferably from about 0.8% to about 20% of a dye maintenance polymer or oligomer having at least three net positive charges per molecule and having a Dye Maintenance Parameter, as determined by the Dye Maintenance Parameter Test, of greater than about 0.23, preferably greater than about 0.6 more preferably greater than about 0.8 and most preferably greater than about 0.9.

The dye maintenance polymer is not a polyethyleneimine or alkoxylated derivative thereof.

In yet another aspect of this invention there is provided a laundry additive composition comprising:

a) from about 1% to about 99% by weight of water; and b) from about 0.01% to about 50%, preferably from about 0.1% to about 40%, more preferably from about 0.5% to about 30%, and most preferably from about 0.8% to about 20% of a dye maintenance polymer or oligomer having at least three net positive charges per molecule and having a Dye Maintenance Parameter, as determined by the Dye Maintenance Parameter Test, of greater than about 0.23, preferably greater than about 0.6 more preferably greater than about 0.8 and most preferably greater than about 0.9.

The dye maintenance polymer is not a polyethyleneimine or alkoxylated derivative thereof.

In addition to the surfactant and the dye maintenance polymer of this invention, the laundry detergent compositions herein comprise from about 0.01% to 80% by weight of an organic or inorganic detergency builder and other conventional laundry detergent products.

In addition to the fabric softener and the dye maintenance polymer of this invention, the fabric softener compositions herein comprise pH adjusters, other carriers and adjunct ingredients.

Aqueous solutions of the dye maintenance polymers of this invention comprise from about 0.05% to about 50% by weight of the dye maintenance polymers of this invention, fabric treatment materials dissolved in water and other ingredients such as stabilizers and pH adjusters.

In its method aspect, the present invention relates to the laundering or treating of fabrics and textiles in aqueous washing, rinsing, or treating solutions formed from effective amounts of any of the detergent compositions, fabric softener compositions, or aqueous solution treatments described herein, or formed from the individual components of such compositions. Laundering of fabrics and textiles in such washing, rinsing and/or treatment solutions, followed by drying, imparts fabric appearance benefits to the fabric and textile articles so treated. Such benefits can include improved overall appearance, pill/fuzz reduction, antifading, improved abrasion resistance, and/or enhanced softness. It has been surprisingly determined that the dye maintenance polymers of this invention impart fabric appearance and integrity benefits that are greater than the benefits achieved by a corresponding amount of either component by itself.

DETAILED DESCRIPTION OF THE INVENTION

As noted, when fabric or textiles are laundered in solutions which comprise the dye maintenance polymers of the present invention fabric appearance and integrity are enhanced. The dye maintenance polymers can be added to wash solutions by incorporating them into a detergent composition, a fabric softener or by adding them separately to the washing solution. The dye maintenance polymers are described herein primarily as liquid or granular detergent additives but the present invention is not meant to be so limited. The dye maintenance polymers, detergent composition components, optional ingredients for such compositions and methods of using such compositions, are described in detail below. All percentages are by weight unless other specified.

Dye Maintenance Polymers

The dye maintenance polymers of this invention can be used in any fabric laundering process and provide certain appearance benefits to the fabrics laundered in these processes. Such fabric appearance benefits can include, for example, improved overall appearance of the laundered fabrics, reduction of the formation of pills and fuzz protection against color fading, improved abrasion resistance, etc. The dye maintenance polymers used in the compositions and methods herein can provide such fabric appearance benefits with acceptably little or no loss in cleaning performance provided by the laundry detergent compositions into which such materials are incorporated.

As will be apparent to those skilled in the art, an oligomer is a molecule consisting of only a few monomer units while polymers comprise considerably more monomer units. For the present invention, oligomers are defined as molecules having an average molecular weight below about 1,000 and polymers are molecules having an average molecular weight of greater than about 1,000. Copolymers are polymers or oligomers wherein two or more dissimilar monomers have been simultaneously or sequentially polymerized. Copolymers of the present invention can include, for example, polymers or oligomers polymerized from a polyfunctional alkylating agent such as epichlorohydrin with a mixture of a cyclic amine-based monomer, e.g., piperazine and another cyclic amine-based monomer, e.g., morpholine.

Cationic polymers in general and their method of manufacture are know. For example, a detailed description of cationic polymers can be found in an article by M. Fred Hoover that was published in the *Journal of Macromolecular Science-Chemistry*, A4(6), pp 1327–1417, October, 1970. The entire disclosure of the Hoover article is incorporated herein by reference. The dye maintenance polymers of this invention will be better understood when read in light of the Hoover article, the present disclosure and the Examples herein.

Table A lists 6 patent applications that describe various dye maintenance polymers according to this invention, methods of making these polymers and methods of using them. The entire disclosure of each of the applications listed in Table A is incorporated herein by reference.

| | | | |
|---|---|---|---|
| Amino Acid Based Polymers to Provide Appearance and Integrity Benefits to Fabrics Laundered Therewith | et al. | | 16536 now U.S. Pat. No. 6,407,053 issued 6/18/02 |
| Laundry Detergent Compositions with Cyclic Amine-Based Polymers to Provide Appearance and Integrity Benefits to Fabrics Laundered Therewith | Panandiker et al. | 9/15/98 | PCT/US98/ 19143, now U.S. Pat. No. 6,251,846 issued 6/26/01 |
| Laundry Detergent Compositions with Amino Acid Based Polymers to Provide Appearance and Integrity Benefits to Fabrics Laundered Therewith | Randall et al. | 8/7/98 | PCT/US98/ 16495, now U.S. Pat. No. 6,214,786 issued 4/10/01 |
| Laundry Detergent Compositions with Anionically Modified, Cyclic Amine Based Polymers | Panandiker et al. | 9/15/98 | PCT/US98/ 19141 now U.S. Pat. No. 6,228,828 issued 5/8/01 |
| Laundry Detergent and Fabric Conditioning Compositions with Oxidized Cyclic Amine Based Polymers | Panandiker et al. | 9/15/98 | PCT/US98/ 19144 now U.S. Pat. No. 6,482,787 issued 11/19/02 |
| Laundry Detergent Compositions with A Combination of Cyclic Amine Based Polymers and Hydrophobically Modified Carboxy Methyl Cellulose | Panandiker et al. | 10/13/98 | 60/103,978, corresponding to U.S. app. Serial No., 09/806,882, now allowed 5/21/03 |

In addition to the dye maintenance polymers of the present invention, the present laundry detergent and additive compositions can include common detergent adjuvants as defined in greater detail below. The detergent compositions of this invention include a surfactant selected from the group consisting of nonionic, anionic, cationic, amphoteric, zwitterionic surfactants and mixtures thereof. Preferably, at least about 4% by weight of the surfactant is an anionic surfactant The most common detergent ingredients that are preferred for use in the present invention include: detersive enzymes, preferably cellulase and preferably an enzyme stabilization system; an inorganic peroxygen bleaching compound, which is preferably selected from the group consisting of alkali metal salts of perborate, percarbonate and mixtures thereof, and a bleach activator, which is preferably nonanoyloxybenzene sulfonate. The laundry additive compositions of this invention preferably comprise a pH adjuster and one or more fabric softening components.

Detersive Surfactant

The detergent compositions herein comprise from about 4% to 80% by weight of a detersive surfactant. Preferably such compositions comprise from about 5% to 50% by weight of surfactant. Detersive surfactants utilized can be of the anionic, nonionic, zwitterionic, ampholytic or cationic type or can comprise compatible mixtures of these types. Detergent surfactants useful herein are described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980. All of these patents are incorporated herein by reference. Of all the surfactants, anionics and nonionics are preferred.

Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms.

Additional non-soap anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Especially valuable are linear straight chain alkylbenzene sulfonates in which the average number of carbon atoms in the alkyl group is from about 11 to 13, abbreviated as $C_{11-13}$ LAS.

Preferred nonionic surfactants are those of the formula $R_1(OC_2H_4)_nOH$, wherein $R_1$ is a $C_{10}$–$C_{16}$ alkyl group or a $C_8$–$C_{12}$ alkyl phenyl group, and n is from 3 to about 80. Particularly preferred are condensation products of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol.

Additional suitable surfactants, including polyhydroxy fatty acid amides and amine based surfactants, are disclosed in one or more of the co-pending PCT Applications listed in Table A and incorporated herein by reference.

Detergent Builder

The detergent compositions herein may also comprise from about 0.1% to 80% by weight of a detergent builder. Preferably such compositions in liquid form will comprise from about 1% to 10% by weight of the builder component. Preferably such compositions in granular form will comprise from about 1% to 50% by weight of the builder component. Detergent builders are well known in the art and can comprise, for example, phosphate salts as well as various organic and inorganic nonphosphorus builders.

Water-soluble, nonphosphorus organic builders useful herein include the various alkali metal, ammonium and substituted ammonium polyacetates, carboxylates, polycarboxylates and polyhydroxy sulfonates. Suitable polycarboxylates for use herein are the polyacetal carboxylates described in U.S. Pat. No. 4,144,226, issued Mar. 13, 1979 to Crutchfield et al., and U.S. Pat. No. 4,246,495, issued Mar. 27, 1979 to Crutchfield et al., both of which are incorporated herein by reference. Particularly preferred polycarboxylate builders are the oxydisuccinates and the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Examples of suitable nonphosphorus, inorganic builders include the silicates, aluminosilicates, borates and carbonates. Particularly preferred are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Also preferred are aluminosilicates including zeolites. Such materials and their use as detergent builders are more fully discussed in Corkill et al., U.S. Pat. No. 4,605,509, the disclosure of which is incorporated herein by reference. Also discussed in U.S. Pat. No. 4,605,509 are crystalline layered silicates which are suitable for use in the detergent compositions of this invention.

Optional Detergent Ingredients

In addition to the surfactants, builders and dye maintenance polymers of the detergent compositions of the present invention can also include any number of additional optional ingredients. These include conventional detergent composition components such as enzymes and enzyme stabilizing agents, suds boosters or suds suppressers, anti-tarnish and anticorrosion agents, bleaching agents, soil suspending agents, soil release agents, germicides, pH adjusting agents, non-builder alkalinity sources, chelating agents, organic and inorganic fillers, solvents, hydrotropes, optical brighteners, dyes and perfumes.

pH adjusting agents may be necessary in certain applications where the pH of the wash solution is greater than about 10.0 because the fabric integrity benefits of the defined compositions begin to diminish at a higher pH. Hence, if the wash solution is greater than about 10.0 after the addition of the dye maintenance polymers of the present invention a pH adjuster should be used to reduce the pH of the washing solution to below about 10.0, preferably to a pH of below about 9.5 and most preferably below about 7.5. Suitable pH adjusters will be known to those skilled in the art.

A preferred optional ingredients for incorporation into the detergent compositions herein comprises a bleaching agent, e.g., a peroxygen bleach. Such peroxygen bleaching agents may be organic or inorganic in nature. Inorganic peroxygen bleaching agents are frequently utilized in combination with a bleach activator.

Useful organic peroxygen bleaching agents include percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, Issued Nov. 20, 1984; European Patent Application EP-A-133,354, Banks et al., Published Feb. 20, 1985; and U.S. Pat. No. 4,412,934, Chung et al., Issued Nov. 1, 1983. Highly preferred bleaching agents also include 6-nonylamino-6-oxoperoxycaproic acid (NAPAA) as described in U.S. Pat. No. 4,634,551, Issued Jan. 6, 1987 to Burns et al.

Inorganic peroxygen bleaching agents may also be used, generally in particulate form, in the detergent compositions herein. Inorganic bleaching agents are in fact preferred. Such inorganic peroxygen compounds include alkali metal perborate and percarbonate materials. For example, sodium perborate (e.g. mono- or tetra-hydrate) can be used. Suitable inorganic bleaching agents can also include sodium or potassium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used. Frequently inorganic peroxygen bleaches will be coated with silicate, borate, sulfate or water-soluble surfactants. For example, coated percarbonate particles are available from various commercial sources such as FMC, Solvay Interox, Tokai Denka and Degussa.

Inorganic peroxygen bleaching agents, e.g., the perborates, the percarbonates, etc., are preferably combined with bleach activators, which lead to the in situ production in aqueous solution (i.e., during use of the compositions herein for fabric laundering/bleaching) of the peroxy acid corresponding to the bleach activator. Various non-limiting examples of activators are disclosed in U.S. Pat. No. 4,915,854, Issued Apr. 10, 1990 to Mao et al.; and U.S. Pat. No. 4,412,934 Issued Nov. 1, 1983 to Chung et al. The nonanoyloxybenzene sulfonate (NOBS) and tetraacetyl ethylene diamine (TAED) activators are typical and preferred. Mixtures thereof can also be used. See also the hereinbefore referenced U.S. Pat. No. 4,634,551 for other typical bleaches and activators useful herein.

Other useful amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenol sulfonate.

Preferred examples of bleach activators of the above formulae include (6-octanamido-caproyl) oxybenzenesulfonate, (6-nonanamidocaproyl)oxybenzenesul-fonate, (6decanamido-caproyl)oxybenzenesulfonate and mixtures thereof as described in the hereinbefore referenced U.S. Pat. No. 4,634,551.

Another class of useful bleach activators comprises the benzoxazin-type activators disclosed by Hodge et al. in U.S. Pat. No. 4,966,723, Issued Oct. 30, 1990, incorporated herein by reference. See also U.S. Pat. No. 4,545,784, Issued to Sanderson, Oct. 8, 1985, incorporated herein by reference, which discloses acyl caprolactams, including benzoyl caprolactam, adsorbed into sodium perborate.

If utilized, peroxygen bleaching agent will generally comprise from about 2% to 30% by weight of the detergent compositions herein. More preferably, peroxygen bleaching agent will comprise from about 2% to 20% by weight of the compositions. Most preferably, peroxygen bleaching agent will be present to the extent of from about 3% to 15% by weight of the compositions herein. If utilized, bleach activators can comprise from about 2% to 10% by weight of the detergent compositions herein. Frequently, activators are employed such that the molar ratio of bleaching agent to activator ranges from about 1:1 to 10:1, more preferably from about 1.5:1 to 5:1.

Additional suitable bleaching agents and bleach activators are disclosed in one or more of the co-pending PCT Applications listed in Table A and incorporated herein by reference.

Another highly preferred optional ingredient in the detergent compositions herein is a detersive enzyme component. Enzymes can be included in the present detergent compositions for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, cellulases, peroxidases, and mixtures thereof of any suitable origin, such as vegetable, animal, bacterial, fungal and yeast origin. Preferred selections are influenced by factors such as pH-activity and/or stability, optimal thermostability, and stability to active detergents, builders and the like. In this respect bacterial or fungal enzymes are preferred, such as bacterial amylases and proteases, and fungal cellulases.

"Detersive enzyme", as used herein, means any enzyme having a cleaning, stain removing or otherwise beneficial effect in a laundry detergent composition. Preferred enzymes for laundry purposes include, but are not limited to, proteases, cellulases, lipases, amylases and peroxidases.

Enzymes are normally incorporated into detergent compositions at levels sufficient to provide a "cleaning-effective amount". The term "cleaning-effective amount" refers to any amount capable of producing a cleaning, stain removal, soil removal, whitening, deodorizing, or freshness improving effect on substrates such as fabrics. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5% preferably 0.01%–1% by weight of a commercial enzyme preparation. Protease enzymes are usually present in such commercial preparations at levels sufficient to provide from 0.005 to 0.1 Anson units (AU) of activity per gram of composition. Higher active levels may be desirable in highly concentrated detergent formulations.

Cellulases usable herein include those disclosed in U.S. Pat. No. 4,435,307, Barbesgoard et al., Mar. 6, 1984, and GB-A-2.075.028; GB-A-2.095.275 and DE-OS-2.247.832. CAREZYME® and CELLUZYME® (Novo) are especially useful. See also WO 9117243 to Novo.

The enzyme-containing compositions herein may optionally also comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, and mixtures thereof, and are designed to address different stabilization problems depending on the type and physical form of the detergent composition.

Detergent Composition Preparation

The detergent compositions according to the present invention can be in liquid, paste or granular form. Such compositions can be prepared by combining the essential and optional components in the requisite concentrations in any suitable order and by any conventional means. The forgoing description of uses for the dye maintenance polymers defined herein are intended to be exemplary and other uses will be apparent to those skilled in the art and are intended to be within the scope of the present invention.

Granular compositions, for example, are generally made by combining base granule ingredients, e.g., surfactants, builders, water, etc., as a slurry, and spray drying the resulting slurry to a low level of residual moisture (5–12%). The remaining dry ingredients, e.g., granules of the essential dye maintenance polymers, can be admixed in granular powder form with the spray dried granules in a rotary mixing drum. The liquid ingredients, e.g., solutions of the essential dye maintenance polymers, enzymes, binders and perfumes, can be sprayed onto the resulting granules to form the finished detergent composition. Granular compositions according to the present invention can also be in "compact form", i.e. they may have a relatively higher density than conventional granular detergents, i.e. from 550 to 950 g/l. In such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt.

Liquid detergent compositions can be prepared by admixing the essential and optional ingredients thereof in any desired order to provide compositions containing components in the requisite concentrations. Liquid compositions according to the present invention can also be in "compact form", in such case, the liquid detergent compositions according to the present invention will contain a lower amount of water, compared to conventional liquid detergents. Addition of the dye maintenance polymers to liquid detergent or other aqueous compositions of this invention may be accomplished by simply mixing into the liquid solutions the desired dye maintenance polymers.

Fabric Laundering Method

The present invention also provides a method for laundering fabrics in a manner which imparts fabric appearance benefits provided by the dye maintenance polymers used herein. Such a method employs contacting these fabrics with an aqueous washing solution formed from an effective amount of the detergent compositions hereinbefore described or formed from the individual components of such compositions. Contacting of fabrics with washing solution will generally occur under conditions of agitation although the compositions of the present invention may also be used to form aqueous unagitated soaking solutions for fabric cleaning and treatment. As discussed above, it is preferred that the washing solution have a pH of less than about 10.0, preferably it has a pH of about 9.5 and most preferably it has a pH of about 7.5.

Agitation is preferably provided in a washing machine for good cleaning. Washing is preferably followed by drying the wet fabric in a conventional clothes dryer. An effective amount of a high density liquid or granular detergent composition in the aqueous wash solution in the washing machine is preferably from about 500 to about 7000 ppm, more preferably from about 1000 to about 3000 ppm.

Fabric Conditioning and Softening

The dye maintenance polymers hereinbefore described as components of the laundry detergent compositions herein may also be used to treat and condition fabrics and textiles in the absence of the detersive surfactant and builder components of the detergent composition embodiments of this invention. Thus, for example, a fabric conditioning composition comprising a fabric softener and the dye maintenance polymer or a fabric treatment composition comprising only the dye maintenance polymers themselves, or comprising an aqueous solution of the dye maintenance polymers, may be added during the rinse cycle of a conventional home laundering operation in order to impart the desired fabric appearance and integrity benefits hereinbefore described.

The fabric softener compositions of the present invention comprise at least about 1%, preferably from about 8%, more preferably from about 20% to about 80%, more preferably to about 60%, most preferably to about 45% by weight, of the composition of one or more fabric softener actives.

The preferred fabric softening actives according to the present invention are amines having the formula:

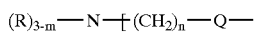

quaternary ammonium compounds having the formula:

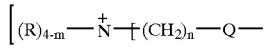

and mixtures thereof, wherein each R is independently $C_1$–$C_6$ alkyl, $C_1$–$C_6$ hydroxyalkyl, benzyl, and mixtures thereof; $R^1$ is preferably $C_{11}$–$C_{22}$ linear alkyl, $C_{11}$–$C_{22}$ branched alkyl, $C_{11}$–$C_{22}$ linear alkenyl, $C_{11}$–$C_{22}$ branched alkenyl, and mixtures thereof; Q is a carbonyl moiety independently selected from the units having the formula:

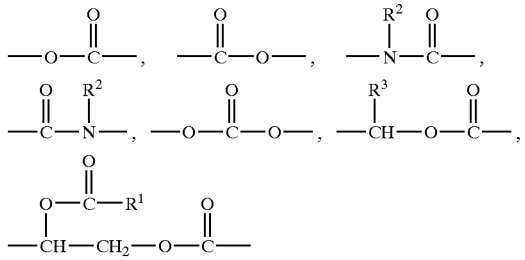

wherein $R^2$ is hydrogen, $C_1$–$C_4$ alkyl, preferably hydrogen; $R^3$ is $C_1$–$C_4$ alkyl, preferably hydrogen or methyl; preferably Q has the formula:

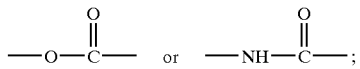

X is a softener compatible anion, preferably the anion of a strong acid, for example, chloride, bromide, methylsulfate, ethylsulfate, sulfate, nitrate and mixtures thereof, more preferably chloride and methyl sulfate. The anion can also, but less preferably, carry a double charge, in which case $X(^-)$ represents half a group. The index m has a value of from 1 to 3; the index n has a value of from 1 to 4, preferably 2 or 3, more preferably 2.

One embodiment of the present invention provides for amines and quaternized amines having two or more different values for the index n per molecule, for example, a softener active prepared from the starting amine methyl(3-aminopropyl)(2-hydroxyethyl)amine.

More preferred softener actives according to the present invention have the formula:

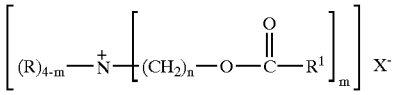

wherein the unit having the formula:

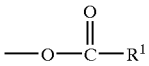

is a fatty acyl moiety. Suitable fatty acyl moieties for use in the softener actives of the present invention are derived from sources of triglycerides including tallow, vegetable oils and/or partially hydrogenated vegetable oils including inter alia canola oil, safflower oil, peanut oil, sunflower oil, corn oil, soybean oil, tall oil, rice bran oil. Yet more preferred are the Diester Quaternary Ammonium Compounds (DEQA's) wherein the index m is equal to 2.

The formulator, depending upon the desired physical and performance properties of the final fabric softener active, can choose any of the above mentioned sources of fatty acyl moieties, or alternatively, the formulator can mix sources of triglyceride to form a "customized blend". However, those skilled in the art of fats and oils recognize that the fatty acyl composition may vary, as in the case of vegetable oil, from crop to crop, or from variety of vegetable oil source to variety of vegetable oil source. DEQA's which are prepared using fatty acids derived from natural sources are preferred.

A preferred embodiment of the present invention provides softener actives comprising $R^1$ units which have at least about 3%, preferably at least about 5%, more preferably at least about 10%, most preferably at least about 15% $C_{11}$–$C_{22}$ alkenyl, including polyalkenyl (polyunsaturated) units inter alia oleic, linoleic, linolenic.

For the purposes of the present invention the term "mixed chain fatty acyl units" is defined as "a mixture of fatty acyl units comprising alkyl and alkenyl chains having from 10 carbons to 22 carbon atoms including the carbonyl carbon atom, and in the case of alkenyl chains, from one to three double bonds, preferably all double bonds in the cis configuration". With regard to the $R^1$ units of the present invention, it is preferred that at least a substantial percentage of the fatty acyl groups are unsaturated, e.g., from about 25%, preferably from about 50% to about 70%, preferably to about 65%. The total level of fabric softening active containing polyunsaturated fatty acyl groups can be from about 3%, preferably from about 5%, more preferably from about 10% to about 30%, preferably to about 25%, more preferably to about 18%. As stated herein above cis and trans isomers can be used, preferably with a cis/trans ratio is of from 1:1, preferably at least 3:1, and more preferably from about 4:1 to about 50:1, more preferably about 20:1, however, the minimum being 1:1.

The level of unsaturation contained within the tallow, canola, or other fatty acyl unit chain can be measured by the Iodine Value (IV) of the corresponding fatty acid, which in the present case should preferably be in the range of from 5 to 100 with two categories of compounds being distinguished, having a IV below or above 25.

Indeed, for compounds having the formula:

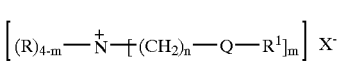

derived from tallow fatty acids, when the Iodine Value is from 5 to 25, preferably 15 to 20, it has been found that a cis/trans isomer weight ratio greater than about 30/70, preferably greater than about 50/50 and more preferably greater than about 70/30 provides optimal concentrability.

For compounds of this type made from tallow fatty acids having a Iodine Value of above 25, the ratio of cis to trans isomers has been found to be less critical unless very high concentrations are needed. A further preferred embodiment of the present invention comprises DEQA's wherein the average Iodine Value for $R^1$ is approximately 45.

The $R^1$ units suitable for use in the isotropic liquids present invention can be further characterized in that the Iodine Value (IV) of the parent fatty acid, said IV is preferably from about 10, more preferably from about 50, most preferably from about 70, to a value of about 140, preferably to about 130, more preferably to about 115. However, formulators, depending upon which embodiment of the present invention they choose to execute, may wish to add an amount of fatty acyl units which have Iodine Values outside the range listed herein above. For example, "hardened stock" (IV less than or equal to about 10) may be combined with the source of fatty acid admixture to adjust the properties of the final softener active.

A prefered source of fatty acyl units, especially fatty acyl units having branching, for example, "Guerbet branching", methyl, ethyl, etc. units substituted along the primary alkyl chain, synthetic sources of fatty acyl units are also suitable. For example, the formulator may with to add one or more fatty acyl units having a methyl branch at a "non-naturally occuring" position, for example, at the third carbon of a $C_{17}$ chain. What is meant herein by the tern "non-naturally occuring" is "acyl units whihc are not found in significant (greater than about 0.1%) quantities is common fats and oils which serve as feedstocks for the source of triglycerides described herein." If the desired branched chain fatty acyl unit is unavailable from readily available natural feedstocks, therefore, synthetic fatty acid can be suitably admixed with other synthetic materials or with other natural triglyceride derived sources of acyl units.

The following are examples of preferred softener actives according to the present invention.

- N,N-di(tallowyl-oxy-ethyl)-N,N-dimethyl ammonium chloride;
- N,N-di(canolyl-oxy-ethyl)-N,N-dimethyl ammonium chloride;
- N,N-di(tallowyl-oxy-ethyl)-N-methyl, N-(2-hydroxyethyl) ammonium methyl sulfate;
- N,N-di(canolyl-oxy-ethyl)N-methyl, N-(2-hydroxyethyl) ammonium methyl sulfate;
- N,N-di(tallowylamidoethyl)-N-methyl, N-(2-hydroxyethyl) ammonium methyl sulfate;
- N,N-di(2-tallowyloxy-2-oxo-ethyl)-N,N-dimethyl ammonium chloride;
- N,N-di(2-canolyloxy-2-oxo-ethyl)-N,N-dimethyl ammonium chloride;
- N,N-di(2-tallowyloxyethylcarbonyloxyethyl)-N,N-dimethyl ammonium chloride;
- N,N-di(2-canolyloxyethylcarbonyloxyethyl)-N,N-dimethyl ammonium chloride;
- N-(2-tallowoyloxy-2-ethyl)-N-(2-tallowyloxy-2-oxo-ethyl)-N,N-dimethyl ammonium chloride;
- N-(2-canolyloxy-2-ethyl)-N-(2-canolyloxy-2-oxo-ethyl)-N,N-dimethyl ammonium chloride;
- N,N,N-tri(tallowyl-oxy-ethyl)-N-methyl ammonium chloride;
- N,N,N-tri(canolyl-oxy-ethyl)-N-methyl ammonium chloride;
- N-(2-tallowyloxy-2-oxoethyl)-N-(tallowyl)-N,N-dimethyl ammonium chloride;

N-(2-canolyloxy-2-oxoethyl)-N-(canolyl)-N,N-dimethyl ammonium chloride;

1,2-ditallowyloxy-3-N,N,N-trimethylammoniopropane chloride; and 1,2-dicanolyloxy-3-N,N,N-trimethylammoniopropane chloride;

and mixtures of the above actives.

Particularly preferred is N,N-di(tallowoyl-oxy-ethyl)-N,N-dimethyl ammonium chloride, where the tallow chains are at least partially unsaturated and N,N-di(canoloyl-oxy-ethyl)-N,N-dimethyl ammonium chloride, N,N-di(tallowyl-oxy-ethyl)-N-methyl, N-(2-hydroxyethyl) ammonium methyl sulfate; N,N-di(canolyl-oxy-ethyl)-N-methyl, N-(2-hydroxyethyl) ammonium methyl sulfate; and mixtures thereof.

Additional fabric softening agents useful herein are described in U.S. Pat. No. 5,643,865 Mermelstein et al., issued Jul. 1, 1997; U.S. Pat. No. 5,622,925 de Buzzaccarini et al., issued Apr. 22, 1997; U.S. Pat. No. 5,545,350 Baker et al., issued Aug. 13, 1996; U.S. Pat. No. 5,474,690 Wahl et al., issued Dec. 12, 1995; U.S. Pat. No. 5,417,868 Turner et al., issued Jan. 27, 1994; U.S. Pat. No. 4,661,269 Trinh et al, issued Apr. 28, 1987; U.S. Pat. No. 4,439,335 Burns, issued Mar. 27, 1984; U.S. Pat. No. 4,401,578 Verbruggen, issued Aug. 30, 1983; U.S. Pat. No. 4,308,151 Cambre, issued Dec. 29, 1981; U.S. Pat. No. 4,237,016 Rudkin et al., issued Oct. 27, 1978; U.S. Pat. No. 4,233,164 Davis, issued Nov. 11, 1980; U.S. Pat. No. 4,045,361 Watt et al., issued Aug. 30, 1977; U.S. Pat. No. 3,974,076 Wiersema et al., issued Aug. 10, 1976; U.S. Pat. No. 3,886,075 Bernadino, issued May 6, 1975; U.S. Pat. No. 3,861,870 Edwards et al., issued Jan. 21 1975; and European Patent Application publication No. 472,178, by Yamamura et al., all of said documents being incorporated herein by reference.

EXAMPLES

The following examples illustrate the compositions and methods of the present invention, but are not necessarily meant to limit or otherwise define the scope of the invention.

Example I

Dye Maintenance Parameter Test

To evaluate a dye maintenance polymer, prepare a 10 ppm solution of the dye maintenance polymer in water. Add 800 ml of this solution to a 1000 mL beaker. Introduce 8 gm+/−50 mg of C110 fabric (C110 is a poplin fabric dyed with Direct Black 112 and supplied by Empirical Manufacturing Company of Cincinnati, Ohio) swatch in the solution such that it is completely immersed in the liquid. Agitate the solution gently with a magnetic stirrer for 120 minutes. A portion of the dye from the fabric will slowly bleed into the water. After 120 minutes, withdraw an aliquot of the liquor, place it in a 5 cm path length cell and measure its absorbance at wavelength of 600 nm with a Hewlett Packard Model 8453 uv-vis spectrophotomer following the general instructions provided by the manufacturer for the use of this instrument. This absorbance is called $Abs_{Polymer}$.

Using the procedure outlined above, repeat the procedure with distilled water alone with no added dye maintenance polymer to obtain $Abs_{Water}$.

The Dye Maintenance Parameter ("DMP") is defined as $(Abs_{Water}-Abs_{Polymer})$

Example II

Calculation of the Average Charge Per Molecule

While there are many ways to calculate the charge density of a polymeric material known to those skilled in the analytical arts, one such method is as follows. Specifically, the charge density for molecules with a known chemical structure, is determined by a standard acid-base titration or a potentiometric titration to give charge to mass ratio. Charge density can then be converted to an average charge per molecule by determining the average molecular weight of the material and simply dividing the charge density by the average molecular weight to determine the average number of positive charges per molecule.

For low molecular weight materials, molecular weight is determined standard techniques such as mass spectrosocpy. For polymeric materials, molecular weight is determined by gel permeation chromatography. These methods are described in analytical text books such as "Instrumental Methods of Analysis" by Willard, Merritt, Dean, and Settle.

Example III

TABLE III comprises numerous examples according to the present invention along with some comparitive examples of material known to the art of laundry detergents. The chemical structures shown in the examples below are idealized structures. Side reactions expected to occur during the condensation are not shown.

TABLE III

| Ex. # | Material | DMP |
|---|---|---|
| 1 | Adduct of Imidazole-epichlorohydrin (Ratio of imidazole:epichlorohydrin 1.36:1) | 1.200 |
| | 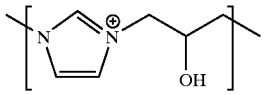 (Idealized Structure) | |
| 2 | Adduct of imidazole, piperazine and epichlorohydrin (ratio 1:1:2) | 0.39 |
| | 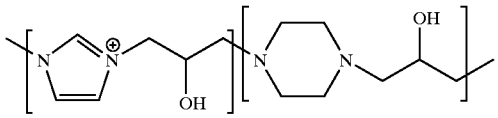 | |

TABLE III-continued

| Ex. # | Material | DMP |
|---|---|---|
| 3 | Adduct of piperazine and epichlorohydrin (ratio 1:1) methyl quat | |
| | 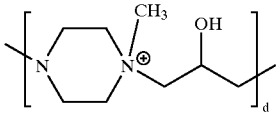 | |
| 4 | Adduct of imidazole, piperazine and epichlorohydrin (ratio 3:1:4) | 1.20 |
| | 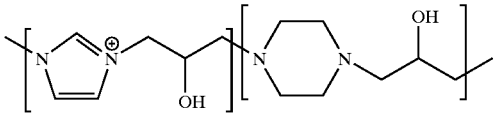 | |
| 5 | Adduct of imidazole-epichlorohydrin and chloroacetic acid (Ratio-1.36:0.97:0.07) | 1.44 |
| | 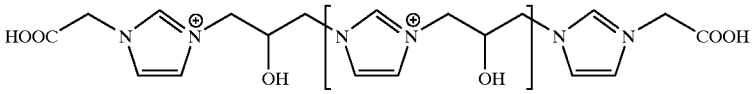 | |
| 6 | Adduct of imidazole-epichlorohydrin and 3 chlorohydroxypropyl sulfonic acid (ratio: 1.0:0.83:0.34) | 1.28 |
| | 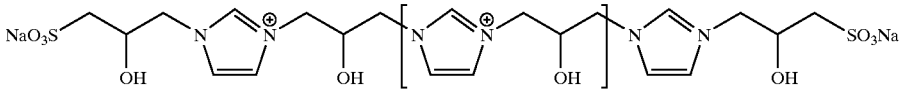 | |
| 7 | Adduct of imidazole, piperazine and epichlorohydrin (Ratio-1.0:3.0:4.0) quat with 0.32 moles of chloroacetate | 1.44 |
| | 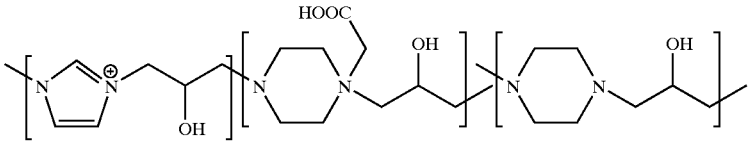 | |
| 8 | Adduct of imidazole and epichlorohdrin, (ratio 1.75:1) oxidized | 1.37 |
| | 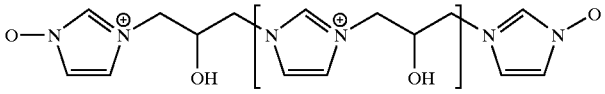 | |
| 9 | Adduct of imidazole, piperazine and epichlorohydrin (ratio 1:1:2) oxidized | 0.33 |
| 10 | Condensation product of lysine and hexamethylenediamine (ratio 5:1) | 1.32 |
| | 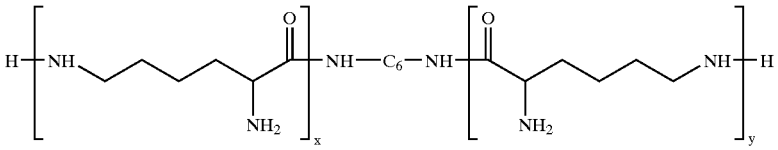 | |
| 11 | Condensation product of lysine and octanoic acid in the ratio 5:1 | 0.42 |
| | 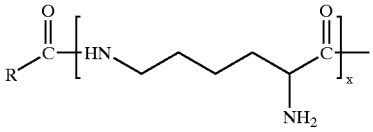 | |
| | $R = C_7H_{15}$ | |

TABLE III-continued

| Ex. # | Material | DMP |
|---|---|---|
| 12 | Condensation product of lysine and dodecylamine in the ratio 5:1 | 0.70 |
| | 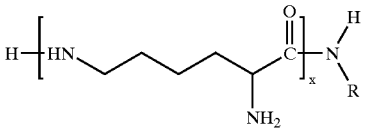 | |
| | R = $C_{11}H_{23}$ | |
| 13 | Adduct of bis(hexamethylenetriamine) and epichlorohydrin in the ratio 1.5:1 | 1.27 |
| | 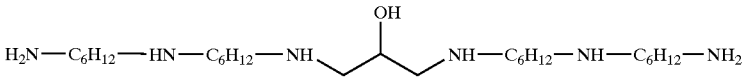 | |
| 14 | Adduct of bis(hexamethylenetriamine) and epichlorohydrin in the ratio 1.5:1 ethoxylated with 0.5 mole of ethylene oxide per N—H | 1.37 |
| 15 | Adduct of bis(hexamethylenetriamine) and epichlorohydrin in the ratio 1.5:1 ethoxylated with 1 mole of ethylene oxide per N—H | 0.75 |
| 16 | N,N bis(aminopropyl)piperazine | 0.81 |
| 17 | Adduct of dimethylamine and epichlorohydrin sold under the trade name Sandofix TP by Clariant, Basel Switzerland. | 1.23 |
| 18 | Adduct of bis(aminopropyl)methylamine and epichlorohydrin in the ratio 1.5:1 | 1.39 |
| | 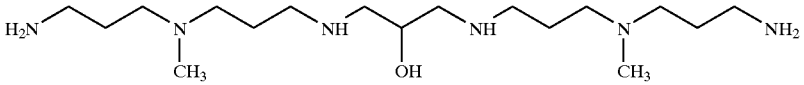 | |
| 19 | Poly(dimethylaminoethyl methacrylate) | 0.68 |
| 20 | Poly(dimethyldiallylammonium chloride) sold under the trade name Merquat 100 by Calgon Corporation, Pittsburg, PA. | 1.26 |
| 21 | Poly(dimethyldiallylammonium chloride-co-acrylamide) sold under the trade name Merquat Plus (Calgon Corporation, Pittsburg, PA). | 0.23 |
| 22 | Poly(dimethyldiallylammonium chloride-co-acrylamide) sold under the trade name Merquat 550 (Calgon Corporation, Pittsburg, PA). | 0.33 |
| 23 | Poly(dimethyldiallylammonium chloride-co-acrylic acid) sold under the trade name Merquat 280 (Calgon Corporation, Pittsburg, PA). | 1.07 |
| 24 | Ionene polymer of N,N,N',N' tetramethyl 1,6 hexanediamine and 1,6 dibromohexane in the ratio 4:3 | 1.37 |
| 25 | Polyvinylamine | 1.06 |
| 26 | Poly(vinylamine-co-vinylalcohol) ratio 1:1 | 1.06 |
| 27 | Poly(vinylamine-co-acrylic acid) ratio 1:1 | |
| 28 | Polyallylamine | 1.08 |
| 29 | poly(vinylamine-co-vinyl formamide) ratio 1:1 | |
| 30 | polyvinylamine ethoxylated with 0.5 moles of ethylene oxide per N—H | |
| 31 | polyvinylamine propoxylated with 0.5 moles of propylene oxide per N—H | |
| 32 | Condensation adduct of guanidine and diethylenetriamine sold under the Trade name Tinofix ECO by Ciba Specialty Chemicals, Basel, Switzerland | |
| 33 | Condensation adduct of guanidine and diethylenetriamine sold under the Trade name Sandofix WE by Clariant, Basel, Switzerland | 0.97 |
| 34 | Polyquaternium 2 (CTFA nomenclature) sold under the trade name Mirapol A15 by Rhone Poulenc, Paris, France. | 1.11 |
| 35 | Polyquaternium 17 (CTFA nomenclature) sold under the trade name Mirapol AD-1 by Rhone Poulenc, Paris, France. | |
| 36 | Copolymer of N methylvinyl pyridine co-vinyl pyridine (ratio 4:1) | 0.99 |
| 37 | Copolymer of N methylvinyl pyridine co-vinyl pyridine (ratio 4:6) | 1.13 |
| 38 | Poly(N methylvinyl pyridine co-vinyl pyridine N oxide) ratio 4:1 | 0.96 |
| 39 | Poly(N methylvinyl pyridine co-vinyl pyridine N oxide) ratio 4:6 | 0.65 |
| | Comparative Examples | |
| 40 | Ethoxylated tetraethylenepentamine example from Vandermeer, U.S. Pat. No. 4,597,898 | |
| 41 | Polyethyleneimine MW 1200 ethoxylated with 1 mole ethylene oxide per N—H, example from Watson, U.S. Pat. No. 5,565,145 | −0.27 |
| 42 | Polyethyleneimine MW 1200 ethoxylated with 7 moles ethylene oxide per N—H, example from Watson, U.S. Pat. No. 5,565,145 | −0.35 |
| 43 | Polyethyleneimine MW 600 ethoxylated with 20 moles ethylene oxide per N—H example from Ghosh, U.S. Pat. No. 5,854,949 | −0.07 |
| 44 | Polyethyleneimine MW 1200 ethoxylated with 7 moles ethylene oxide per N—H, 9.5% methyl quat example from Ghosh, U.S. Pat. No. 5,854949 | 0.09 |
| 45 | Poly(vinyl pyridine-N oxide) example from Fredj, U.S. Pat. No. 5,783548 | 0.03 |
| 46 | Poly(vinyl pyrrolidone), commercial material available from International Specialty Products, Wayne, NJ | |
| 47 | Poly(vinyl pyrrolidone-co-vinyl imidazole) example from Busch U.S. Pat. No. 5,710,119 | |
| 48 | Poly(e-aminocaprolactam-co-caprolactam) sold under the trade name Nylon AQ A90 by Toray, Japan | −0.09 |

Example IV

Granular Detergent Test Composition Preparation

Several heavy duty granular detergent compositions are prepared containing one or more dye maintenance polymer having a DMP according to this invention. These granular detergent compositions all have the following basic formula:

TABLE IV

| Component | Wt. % |
|---|---|
| $C_{12}$ Linear alkyl benzene sulfonate | 9.31 |
| $C_{14-15}$ alkyl ether (0.35 EO) sulfate | 12.74 |
| Zeolite Builder | 27.79 |
| Sodium Carbonite | 27.31 |
| PEG 4000 | 1.60 |
| Dispersant | 2.26 |

TABLE IV-continued

| Component | Wt. % |
|---|---|
| $C_{12-13}$ Alcohol Ethoxylate (9 EO) | 1.5 |
| Sodium Perborate | 1.03 |
| Soil Release Polymer | 0.41 |
| Enzymes | 0.59 |
| Dye Maintenance Polymer | 3.0 |
| Perfume, Brightener, Suds Suppressor, Other Minors, Moisture, Sulfate | Balance |
| | 100% |

Example V

Liquid Detergent Test Composition Preparation

Several heavy duty liquid detergent compositions arc prepared containing one or more dye maintenance polymer having a DMP according to this invention. These liquid detergent compositions all have the following basic formula:

TABLE V

| Component | Wt. % |
|---|---|
| $C_{12-15}$ alkyl ether (2.5) sulfate | 38 |
| $C_{12}$ glucose amide | 6.86 |
| Citric Acid | 4.75 |
| $C_{12-14}$ Fatty Acid | 2.00 |
| Enzymes | 1.02 |
| MEA | 1.0 |
| Propanediol | 0.36 |
| Borax | 6.58 |
| Dispersant | 1.48 |
| Na Toluene Sulfonate | 6.25 |
| Dye Maintenance Polymer | 1.0 |
| Dye, Perfume, Brighteners, Preservatives, Suds Suppressor, Other Minors, Water | Balance |
| | 100% |

Example VI

Granular Detergent Test Composition Preparation

Several granular detergent compositions are prepared containing one or more dye maintenance polymer having a DMP according to this invention. Such granular detergent compositions all have the following basic formula:

TABLE VI

| Component | Example Wt.% | Comparative Wt% |
|---|---|---|
| Na $C_{12}$ Linear alkyl benzene sulfonate | 9.40 | 9.40 |
| Na $C_{14-15}$ alkyl sulfonate | 11.26 | 11.26 |
| Zeolite Builder | 27.79 | 27.79 |
| Sodium Carbonate | 27.31 | 27.31 |
| PEG 4000 | 1.60 | 1.60 |
| Dispersant, Na polyacrylate | 2.26 | 2.26 |
| $C_{12-13}$ alkyl ethoxylate (E9) | 1.5 | 1.5 |
| Sodium Perborate | 1.03 | 1.03 |
| Dye Maintenance Polymer | 0.8 | 0 |
| Other Adjunct ingredients | Balance | Balance |
| | 100% | 100% |

Example VII

Fabric Softener Test Composition Preparation

Several fabric softener compositions are prepared containing one or more dye maintenance polymer having a DMP according to this invention. Such fabric softener compositions can have any of the following basic formulae:

TABLE VIIa

| | Percent by Weight | | | | | |
|---|---|---|---|---|---|---|
| Ingredients | 1 | 2 | 3 | 4 | 5 | 6 |
| Softener active[1] | 24.0 | — | — | — | — | 25.0 |
| Softener active[2] | — | — | 19.2 | — | — | — |
| Softener active[3] | — | — | — | — | 18.0 | — |
| Softener active[4] | — | 11.0 | — | 4.0 | — | — |
| Softener active[5] | — | 13.5 | — | — | — | — |
| Softener active[6] | — | | — | 3.4 | — | — |
| Dye Maintenance Polymer | 0.5 | 0.5 | 1.0 | 2.0 | 3.0 | 5.0 |
| Ethanol | 4.0 | 5.0 | — | 1.0 | — | 4.0 |
| Isopropanol | — | — | 3.0 | — | 6.0 | — |
| Color care agent[10] | 2.5 | 3.0 | 3.0 | 3.0 | 4.0 | — |
| Calcium chloride | 2.0 | 0.5 | 0.2 | 0.05 | 0.5 | 0.6 |
| Hydrochloric acid | 0.75 | — | 0.06 | 0.2 | 0.02 | 0.05 |
| Soil release agent[11] | 0.5 | — | 0.2 | — | — | 0.5 |
| Polyamine[12] | 1.0 | 1.0 | 1.5 | 1.5 | 2.0 | 2.0 |
| Silicone anti-foam | 0.01 | — | 0.01 | 0.01 | — | 0.01 |
| Miscellaneous | 1.4 | 1.0 | 0.7 | 0.4 | 1.0 | 1.3 |
| Water | balance | balance | balance | balance | balance | balance |

[1]N,N-di(tallowyl-oxy-ethyl).N,N-dimethyl ammonium chloride (tallowyl having an I.V. of 50).
[2]N,N-di(tallowyl-oxy-ethyl)-N,N-dimethyl ammonium chloride (tallowyl having an I.V. of 18).
[3]1,2-Ditallowyloxy-3-N,N,N-trimethylammoniopropane chloride.
[4]Ditallow dimethyl ammonium chloride.
[5]Methyl bis(tallow amidoethyl)-2-hydroxyethyl ammonium methyl sulfate.
[6]1-Tallowamidoethyl-2-imidazoline.
[10]N,N,N',N'-terakis(2-hydroxypropyl)ethylenediamine.
[11]Dimethyl terephthalate, 1,2-propylene glycol, methyl capped PEG polymer.
[12]N,N'-bis(3-aminopropyl)-1,3.propylenediamine.

TABLE VIIb

| | Percent by Weight | | | |
|---|---|---|---|---|
| Ingredients | 7 | 8 | 9 | 10 |
| DEQA[1] | 26.0 | 25.7 | — | 30.0 |
| MAQ[2] | — | — | 26.0 | — |
| dye maintenance polymer | 0.5 | 1.0 | 2.0 | 5.0 |
| Ethanol | 2.2 | 2.4 | 2.2 | 2.6 |
| Hexylene glycol | 2.6 | 2.3 | 2.6 | 2.6 |
| 1,2-Hexanediol | 17.0 | — | 17.0 | — |
| TMPD[6] | — | 11.9 | — | 12.0 |
| CHDM[7] | — | 5.0 | — | 48.1 |
| Water | 52.5 | 53.6 | 52.5 | 48.1 |
| Minors[8] | balance | balance | balance | balance |

[1]N,N-di(canoyloxyethyl)-N-2-hydroxyethyl-N-methyl ammonium methyl sulfate available from Witco.
[2]Monocanolyl trimethyl ammonium chloride, available as Adogen 417 ® from Witco.
[6]N,N'-(3-aminopropyl)ethylenediamine.
[7]N,N'-(3-aminopropyl)butylenediamine.
[8]Tripropylenetetraamine.
[9]Trimethyl pentanediol available from Eastman Chemical.
[10]1,4-cyclohexane dimethanol available from Eastman Chemical.
[11]Minors can include perfume, dye, acid, preservatives, etc.

Example VIII

Aqueous Treatment Composition Preparation

Several aqueous treatment compositions are prepared containing one or more dye maintenance polymer having a DMP according to this invention. Such treatment compositions can have any of the following basic formulae:

TABLE VIII

| | Percent by Weight | | | | |
|---|---|---|---|---|---|
| Ingredients | 1 | 2 | 3 | 4 | 5 |
| Cationic dye fixative[2] | — | 3.00 | — | — | — |
| Hydrophobic dispersant[3] | 25.00 | 10.00 | 15.00 | — | — |
| Hydrophobic dispersant[4] | — | — | — | 10.00 | — |
| Hydrophobic dispersant[5] | — | — | — | — | 50.00 |
| Anti-scaling agent[6] | 1.00 | — | — | 1.00 | — |
| Anti-scaling agent[7] | — | — | — | — | 2.00 |
| Enzyme[8] | — | 0.50 | — | — | — |
| Polyamine[9] | 10.00 | 20.00 | 5.00 | | — |
| Dye Maintenance Polymer | 0.5 | 3.0 | 2.0 | 10.0 | 7.0 |
| Perfume | 0.15 | 0.40 | 0.10 | 0.15 | 0.15 |
| Miners | balance | balance | balance | balance | balance |

[1]N,N-di-(canolyl-oxy-ethyl)-N-methyl-N-(2-hydroxyethyl) ammonium methyl sulfate.
[2]Selected from REWIN SRF, REWIN SRF-O and REWIN DWR ex CHT-Beitlich GMBH.
[3]Polyalkyleneimine having a molecular weight of 1800 and an average ethoxylation per backbone nitrogen of approximately 4.
[4]Polyalkyleneimine having a molecular weight of 1800 and an average ethoxylation per backbone nitrogen of approximately 1.
[5]Polyalkyleneimine having a molecular weight of 1800 and an average ethoxylation per backbone nitrogen of approximately 7.
[6]Hydroxyethanediphosphonate (HEDP).
[7]BAYHIBIT AM ex Baeyer.
[8]Suitable enzymes include cellulase, lipase, protease, peroxidase, and mixtures thereof.
[9]N,N'-bis(propyleneamino)-1,4-piperazine.

What is claimed is:

1. A detergent composition comprising:

a) from 5% to about 70% of a $C_{10}$–$C_{20}$ sulfated or sulfonated anionic surfactant, b) from 0.01% to 10%, of a dye maintenance polymer or oligomer which is a member selected from the group consisting of imidazole-epichlorohydrin adducts, imidazole-piperazine-epichlorohydrin adducts, piperazine-epichlorohydrin adducts, and oxidized imidazole-epichlorohydrin adducts, said polymer or oligomer having at least three net positive charges per molecule and having a Dye Maintenance Parameter, as determined by the Dye Maintenance Parameter Test, of greater than 0.23.

2. The detergent composition of claim 1, wherein the composition further comprises a detersive enzyme and an enzyme stabilization system.

3. The detergent composition of claim 1, wherein the composition further comprises an inorganic peroxygen bleaching compound, which is selected from the group consisting of alkali metal salts of perborate, percarbonate and mixtures thereof, and a bleach activator, which is nonanoyloxybenzene sulfonate.

4. The detergent composition of claim 1, wherein the composition further comprises a cellulose enzyme.

5. The detergent composition of claim 1, comprising an additional surfactant selected from the group consisting of nonionic, cationic, amphoteric, and zwitterionic surfactants and mixtures thereof.

6. A detergent composition according to claim 1 wherein the dye maintenance polymer or oligomer has a Dye Maintenance Parameter, as determined by the Dye Maintenance Parameter Test, of greater than 0.9.

7. A detergent composition according to claim 1, wherein the anionic surfactant is an alkyl benzene sulfonate.

8. A detergent composition according to claim 7 wherein said alkyl benzene sulfonate comprises from about 9% to about 50%, by weight, of said composition.

9. A detergent composition according to claim 1 wherein the anionic surfactant is an alkyl ethoxy sulfate.

10. A detergent composition according to claim 9 wherein said alkyl ethoxy sulfate comprises from about 9% to about 50%, by weight, of said composition.

* * * * *